US006991260B2

(12) United States Patent
Fan et al.

(10) Patent No.: US 6,991,260 B2
(45) Date of Patent: Jan. 31, 2006

(54) ANTI-COUNTERFEITING SEE-THROUGH SECURITY FEATURE USING LINE PATTERNS

(75) Inventors: Zhigang Fan, Webster, NY (US); Shen-ge Wang, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 59 days.

(21) Appl. No.: 10/284,551

(22) Filed: Oct. 30, 2002

(65) Prior Publication Data

US 2004/0084894 A1 May 6, 2004

(51) Int. Cl.
*B42D 15/00* (2006.01)

(52) U.S. Cl. ..... 283/72; 283/91; 283/94; 283/114; 428/29; 428/30; 428/32.13; 428/32.14; 428/32.15; 428/916; 428/42.1; 382/260; 382/263; 359/2

(58) Field of Classification Search ..... 428/29, 428/30, 916, 32.13–32.15; 283/72, 91, 94, 283/114; 382/260, 263; 359/2
See application file for complete search history.

(56) References Cited

U.S. PATENT DOCUMENTS

| | | | | |
|---|---|---|---|---|
| 3,675,948 | A * | 7/1972 | Wicker | 283/67 |
| 4,537,504 | A * | 8/1985 | Baltes et al. | 356/71 |
| 4,632,430 | A * | 12/1986 | Wicker | 283/97 |
| 4,766,026 | A * | 8/1988 | Lass et al. | 428/203 |
| 4,894,110 | A * | 1/1990 | Lass et al. | 156/272.8 |
| 4,896,901 | A * | 1/1990 | Ekelund | 283/90 |
| 5,093,184 | A * | 3/1992 | Edwards | 428/195.1 |
| 5,291,243 | A * | 3/1994 | Heckman et al. | 399/3 |
| 5,851,032 | A * | 12/1998 | Green | 283/72 |
| 6,089,614 | A | 7/2000 | Howland et al. | 283/91 |
| 6,273,473 | B1 * | 8/2001 | Taylor et al. | 283/72 |
| 6,337,752 | B1 * | 1/2002 | Heckenkamp et al. | 359/2 |
| 6,467,810 | B2 * | 10/2002 | Taylor et al. | 283/72 |
| 6,471,248 | B2 * | 10/2002 | Hardwick et al. | 283/72 |
| 6,494,491 | B1 * | 12/2002 | Zeiter et al. | 283/91 |
| 2002/0117845 | A1 * | 8/2002 | Ahlers et al. | 283/72 |
| 2002/0185857 | A1 * | 12/2002 | Taylor et al. | 283/72 |
| 2003/0015866 | A1 * | 1/2003 | Cioffi et al. | 283/72 |
| 2003/0137145 | A1 * | 7/2003 | Fell et al. | 283/72 |
| 2004/0084893 | A1 * | 5/2004 | Fan et al. | 283/72 |
| 2005/0115425 | A1 * | 6/2005 | Plaschka et al. | 101/170 |

FOREIGN PATENT DOCUMENTS

| | | | |
|---|---|---|---|
| GB | 2282563 | A2 * | 12/1995 |
| WO | WO00/00356 | * | 1/2000 |

* cited by examiner

*Primary Examiner*—Boyer Ashley
*Assistant Examiner*—Mark Henderson
(74) *Attorney, Agent, or Firm*—Oliff & Berridge, PLC

(57) ABSTRACT

Patterns are aligned on the front and back surfaces of a document to provide an anti-counterfeiting security device. The document is sufficiently transparent to allow see-through of the partial image on the back of the document to be superimposed on the partial image on the front of the document to form a complete image if the patterns are properly aligned. The complete image will disappear if misaligned.

9 Claims, 4 Drawing Sheets

ANTI-COUNTERFEITING SEE-THROUGH SECURITY FEATURE USING LINE PATTERNS

BACKGROUND OF THE INVENTION

The present invention relates generally to anti-counterfeiting patterns on a document and, more particularly, to line patterns on the front and back surfaces of a document which allow a document holder to verify the authenticity of the document and which have enhanced security protection against copying of the document.

A great number of printed documents require highly reliable means of ensuring their authenticity. These documents include currency, negotiable instruments, stock certificates, checks, tickets and the like. The means employed to indicate authenticity for the document should be permanent, durable, and difficult to replicate to allow the public at large to rely on the authenticity of the documents. This latter quality is particularly important to preclude, or at least to dissuade attempts at counterfeiting the documents in order to ensure a maximum degree of confidence in the original document. In the case of banknotes, passports, checks, and other intrinsically valuable documents, confidence in the authenticity of the document is especially important, as any member of the public might become a holder or user of the document at any time.

The criteria for an effective document security feature are relatively easy to formulate. Such features should be difficult to replicate to deter potential counterfeiters. The features should permit ready detection by means available to ordinary holders or users of the final document. For banknotes and other documents on whose authenticity the public at large relies, the features should be discernible and verifiable under ordinary light conditions.

The increasing popularity of color photocopiers and other imaging systems, and the improving technical quality of color photocopiers, has led to an increase in the counterfeiting of such documentation.

A wide variety of security features for documents have been proposed previously. Examples of such security features include: optically variable devices, such as holograms and diffraction gratings; security threads or strips; microprint; watermarks; fine line or 'filigree' patterns; or color-shifting inks, fluorescent inks, and phosphorescent inks.

These measures naturally add to the complexity and production cost of the documents.

A disadvantage is that several of these document security features may require an optical filter or other external equipment, to provide the required lighting condition for verification of the security device. For example, fluorescent inks may require a source of ultraviolet light for their verification, and microprint, fine line and filigree patterns may require a magnifying lens for verification or may only be machine readable.

To prevent unauthorized duplication or alteration of documents, frequently special indicia or a background pattern are provided for document sheet materials. The indicia or background pattern is imposed upon the sheet material usually by some type of printing process such as offset printing, lithography, letterpress or other like mechanical systems, by a variety of photographic methods, by xerographic printing, and a host of other methods. Most of these patterns placed on sheet materials depend upon complexity and resolution to avoid ready duplication. Consequently, they add an increment of cost to the sheet material without being fully effective in many instances in providing the desired protection from unauthorized duplication or alteration.

It is an object of the present invention to provide a low cost, anti-counterfeiting pattern on a document which is easy to manufacture and yet difficult to counterfeit.

It is another object of the present invention to provide an anti-counterfeiting pattern on a document which a document user or holder with no additional external equipment can verify the authenticity of the document.

SUMMARY OF THE INVENTION

According to the present invention, line patterns are aligned on the front and back surfaces of a document to provide an anti-counterfeiting security device. The document is sufficiently transparent to allow see-through of the partial image pattern on the back of the document to be superimposed on the partial image pattern on the front of the document to form a complete image if the patterns are properly aligned. The patterns will not form a complete pattern if misaligned.

Other objects and attainments together with a fuller understanding of the invention will become apparent and appreciated by referring to the following description and claims taken in conjunction with the accompanying drawings.

BRIEF DESCRIPTION OF THE DRAWINGS

A more complete appreciation of the invention and many of the attendant advantages thereof will be readily obtained and understood by referring to the following detailed description and the accompanying drawings in which like reference numerals denote like elements as between the various drawings. The drawings, briefly described below, are not to scale.

DETAILED DESCRIPTION

In the following detailed description, numeric ranges are provided for various aspects of the embodiments described. These recited ranges are to be treated as examples only, and are not intended to limit the scope of the claims hereof. In addition, a number of materials are identified as suitable for various facets of the embodiments. These recited materials are to be treated as exemplary, and are not intended to limit the scope of the claims hereof. In addition, the figures are not drawn to scale for ease of understanding the present invention.

In the present invention, gray image data may be characterized as image signals, each pixel of which is defined at a single level or optical density in a set of 'c' optical density levels, the number of members in the set of levels being larger than desired. Each pixel will be processed in the manner described herein below, to redefine each pixel in terms of a new, smaller set of 'd' levels In this process, 'c' and 'd' are integer values representing pixel depth, or a number of signal levels at which the pixel may appear. One common case of this method includes the conversion of data from a relatively large set of gray levels to one of two legal or allowed binary levels for printing in a binary printer.

As used herein, the term "dot pattern" refers to a product or an image resulting from a screening process. A "screen cell", as used herein, refers to the set of pixels which together will form the dot pattern, while the term "screen matrix" will be used to describe the set of values which together make up the set of threshold to be applied. A "pixel" refers to an image signal associated with a particular position in an image, having a density between white and black. Accordingly, pixels are defined by intensity and position. A dot pattern is made up of a plurality of pixels. These terms are used for simplification and it should be understood that the appropriate sizing operations have to be performed for images where the input resolution in terms of scan pixels is different from the output resolution in terms of print pixels.

The present invention allows for a gray pattern to be used on a document, where the gray pattern can be generated using a halftoning process to produce a desirable gray.

Each location in an image may be called a "pixel." In an array defining an image in which each item of data or image signal provides a value, each value indicating the color of a location may be called a "pixel value". Each pixel value is a bit in a "binary form" of an image, a gray scale value in a "gray scale form" of an image, or a set of color space coordinates in a "color coordinate form" of an image, the binary form, gray scale form, and color coordinate form each being a two-dimensional array defining the image.

Figure 1:
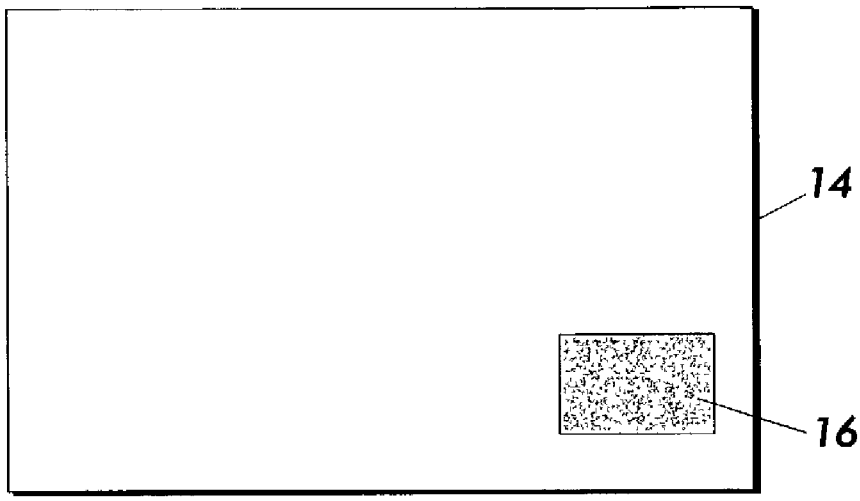
FIG. 1 is a front view of the anti-counterfeiting feature on a document of the present invention.
Figure 2:
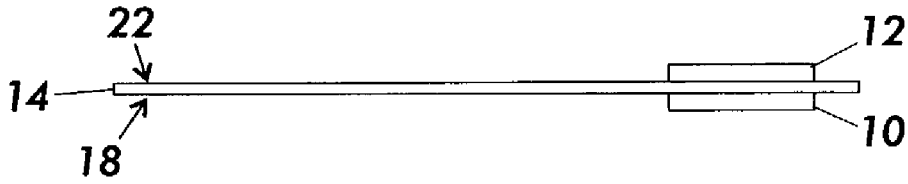
FIG. 2 is a top view of the anti-counterfeiting feature on a document of FIG. 1.

Reference is now made to FIGS. 1 and 2, wherein there is illustrated see-through line patterns 10, 12 on a document 14 for an anti-counterfeiting security feature 16 in accordance with this invention.

Figure 3:
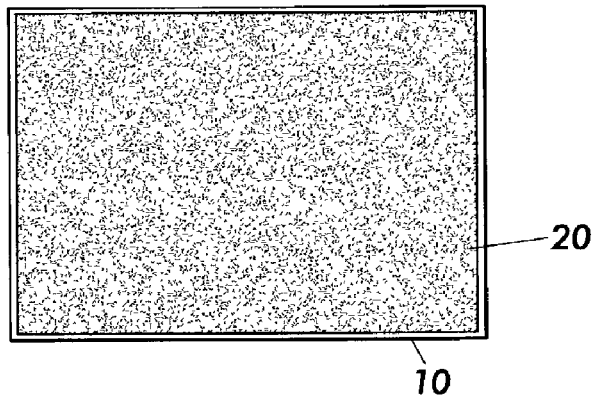
FIG. 3 is an illustration of the first pattern of the anti-counterfeiting feature on a document of FIG. 1.

A first pattern 10 is on the front surface 18 of document 14. As shown in FIG. 3, the first pattern 10 has a plurality of pixels 20 characterizing gray image data.

Figure 4:
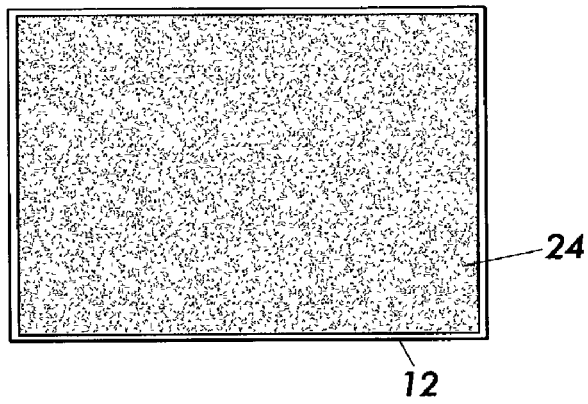
FIG. 4 is an illustration of the second pattern of the anti-counterfeiting feature on a document of FIG. 1.

A second pattern 12 is on the back surface 22 of document 14. As shown in FIG. 4, the second pattern 10 has a plurality of pixels 24 characterizing gray image data. The first pattern 10 and its image data is different from the second pattern 12 and its image data. The first pattern 10 and the second pattern 12 are aligned on opposite surfaces of the document. The first and second patterns can be formed by halftoning.

The first and second patterns 10, 12 only cover a portion 16 of the front and back surface 18, 20 of the document 14. The document 14 will carry conventional printing (not shown) adjacent to the security feature portion 16.

The patterns 10, 12 can be provided in any conventional manner using conventional inks such as black inks, colored inks, white inks, metallic inks, or optically variable inks.

An important aspect of the see-through patterns 10, 12 on the document 14 is its ability to permit verification of authenticity by any holder and under normal light conditions.

The document 14 will be transparent enough, or alternately the security feature portion 16 with the patterns 10, 12 will be transparent enough, to permit see-through under normal light 26 by a document holder. The document 14 will typically be a paper such as rag paper and the like but could also comprise a plastics material such as a plastics film or other material such as credit card material, non-wovens and the like. Alternately, the security feature portion 16 will be defined by a plastic insert within a surrounding paper document 14.

Figure 5:
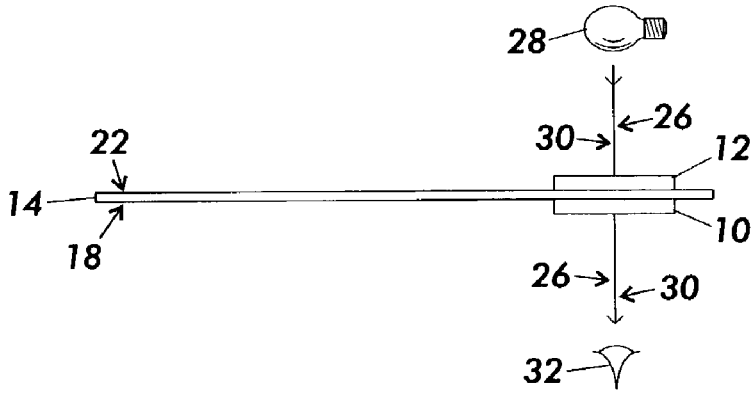
FIG. 5 is a schematic view of light transmission through the see-through anti-counterfeiting feature on a document of FIG. 1.

A light beam 26, such as visible light in the range of wavelengths between about 380 and 720 nanometers, from a light source 28, either natural or artificial, is incident on the document 14. The light beam 26 is either transmitted through the document, absorbed by the document, or reflected from the document. As represented by the line 30 in FIG. 5, transmitted light 26 enters the document through back surface 22, passes through the document 14, and emerges from the front surface 18 to be seen by observer 32.

Figure 6:
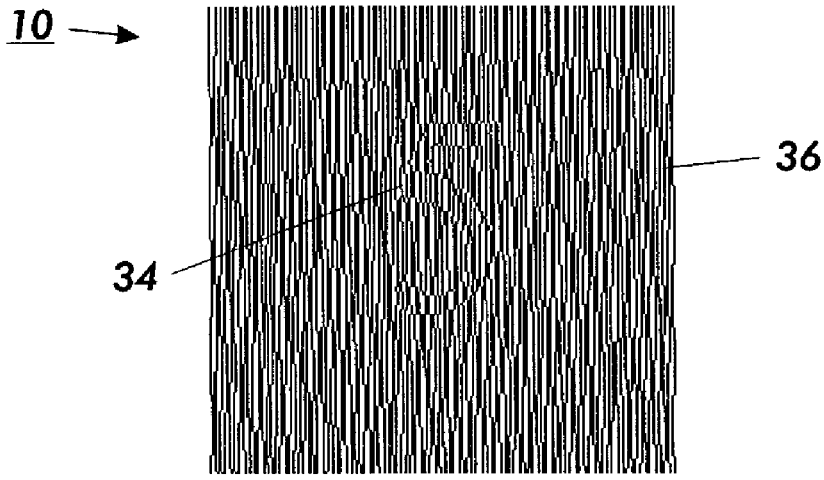
FIG. 6 is an illustration of the first partial image and the line pattern background of the first pattern of the anti-counterfeiting feature on a document of FIG. 1.
Figure 7:
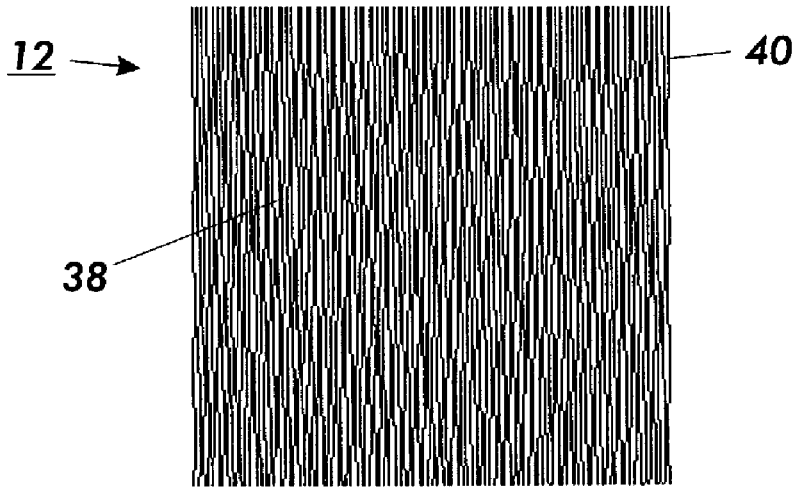
FIG. 7 is an illustration of the second partial image and the line pattern background of the second pattern of the anti-counterfeiting feature on a document of FIG. 1.

When overlapping the second pattern 12 during see-through, the first pattern 10, as seen in FIG. 6, has a first partial image 34 and a background pattern of a plurality of vertical parallel lines 36 formed from the gray image data. When overlapping the first pattern 10 during see-through, the second pattern 12, as seen in FIG. 7, has a second partial image 38 and a background pattern of a plurality of vertical parallel lines 40 formed from the gray image data.

Returning to FIG. 5, an observer 32 viewing the document 14 from the front side 18 with the light 26 behind the back side 22 of the document will "see through" the document 14 and view the second pattern 12 on the back surface 22 aligned with and superimposed on the first pattern 10 on the front surface 18.

Figure 8:
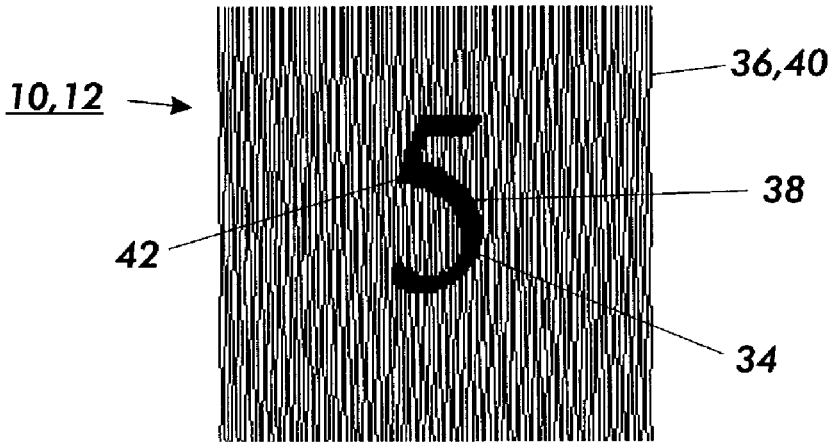
FIG. 8 is an illustration of the superimposition of the first pattern and the second stochastic pattern when aligned to form a complete authentication image.

As shown in FIG. 8, the vertical parallel lines 36 of the pattern 10 on the front surface 18 are superimposed on the vertical parallel lines 40 of the pattern 12 on the back surface 22. The second partial image 38 on the back surface 22 is aligned with the complementary first partial image 34 on the front surface 18 to form a complete image 42. The resulting complete image 42 serves as an authentication mark for the document.

Preferably, the partial images 34, 38 of the first and second patterns 10, 12 each define a characteristic image. The first and second pattern define recognizable patterns (such as security patterns) or images such as geometric shapes, graphic illustrations, alphanumeric characters and other curvilinear patterns. This enables the document easily to be authenticated either by the eye of the holder or by a machine in the case of a machine readable image.

Figure 9:
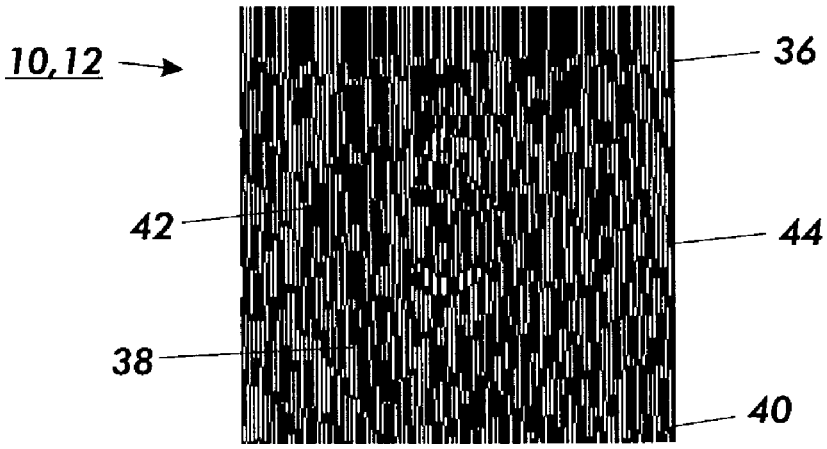
FIG. 9 is an illustration of the superimposition of the first pattern and the second pattern when misaligned to cause the disappearance of the authentication image.

As shown in FIG. 9, if the first pattern 10 on the front surface 18 of the document 14 is misaligned or not in perfect registration with the second pattern 12 on the back surface 22, then an observer will not be able to view the authentication image 42. The disappearance of the authentication image 42 is caused by the phase shift between the background line patterns and/or the angular rotation of the background line patterns relative to each other. The disappearance of the authentication image 42 serves as a sign of counterfeiting for the document. The second partial image 38 on the back surface 22 is misaligned with the first partial image 34 on the front surface 18 upon see-through of the document 14 with a light behind the document.

Printing of the halftoning patterns 10, 12 on the document 14 is normally carried out with specialized lithographic presses which allow simultaneous front and back surface 18, 22 printing during one printing run. In this way, the tolerances applied to the patterns 10, 12 are typically a fraction of a millimeter and any variation caused by counterfeiting by printing both sides 18, 22 during different printing runs can be quickly noticed. By printing on both sides 18, 22 in a single impression, misregister due to variations in the dimensions and thickness of the document 14 caused by change of moisture content or heating and the like are avoided. In all cases, the first and second patterns 10, 12 can be provided by printing such as offset, gravure or screen printing or by any other suitable technique such as a transfer process.

The primary advantage of a see-through security feature is the difficulty in counterfeiting such features. Partly, this is due to the need to achieve exact registration between the patterns on each side of the document and partly due to the fact that the counterfeiter may not even realize that the feature exists.

A high level of transparency for the document 14 is advantageous since it allows the use of the patterns 10, 12 which cannot normally be distinguished due to problems of light diffusion as light passes through the substrate. Specialty colors for the patterns 10, 12 are permitted because they are more difficult for a counterfeiter to faithfully reproduce with a color copier, printer or scanner.

The front and back partial images of the first and second patterns are printed in perfect registration and alignment.

The design of the partial images and the patterns is done so that any slight misalignment would be obvious through the disappearance of the authentication image when viewed in transmission and hence would be an indication that the document was counterfeit.

If an almost perfect registration can be achieved in the original printing, the present invention can be applied to detect counterfeit copies that are produced by equipment with less registration accuracy by the disappearance of the authentication image. The present invention provides a better detection resolution. The patterns are highly sensitive to mis-registration and misalignment.

Halftoning as used in the present invention refers to techniques that create the visual illusion of gray scale using a dot pattern that has only two levels of gray. A normal printing process is binary in nature in that it cannot adjust the density of ink for each spot on the paper. Rather, it can only either print an ink on a spot or leave it blank. For black ink on white paper, the process makes the spot either black or white. To print pictures with gray tones like the patterns on the document, halftoning must be used.

Halftoning is a binary encoding method. The basic idea is to print black points or groups of black points in such a way that the local point density is roughly equal to the average gray value in the corresponding regions of the source picture. The printing is controlled in such a fine fashion that the human eye cannot completely resolve the individual printed points or individual groups of points. The printed picture then appears to have continuous gray tones because of the spatial integration performed by the eye. The high resolution of a printer that cannot be fully perceived by the human eye is used to create an illusion of gray scale.

The halftone screen is used to create the halftone patterns 10, 12 printed on the document 14. The frequency of the screen and the printed pattern is high (usually 300 dpi or higher) relative to the resolving capability of the eye. A halftone image can be obtained by thresholding, pixel by pixel, a gray level source image against a uniformly distributed random noise or dither.

A stochastic screen can be used to produce the invisible partial images and line patterns of the present invention. A stochastic halftone cell is a large threshold array that produces random appearing patterns in the halftone image. To produce an invisible image pattern, at least one additional stochastic cell is produced and used to incorporate image pattern information into the document. In the following embodiment only one additional stochastic screen cell will be described. This is not intended to limit the number of cells that can be used, since the extension to more stochastic screen cells is straightforward.

To produce an invisible image pattern, a first stochastic screen is produced to reproduce a gray image with acceptable image quality. A second stochastic screen is produced that is related to the first. Over most of the two halftone cells, the thresholds are identical, and therefore the patterns they produce are correlated. Over a part of the second halftone cell, the thresholds are randomized so that in this region the two cells are uncorrelated. The locations of the thresholds within this area are optimized a second time to produce pleasing patterns. In this way, the second stochastic cell produces patterns of the same image quality as the first cell. When an image is halftoned with these two cells and the images overlaid, the regions that are uncorrelated will appear darker. By alternating the two halftone cells, image pattern information can be incorporated into the halftoned image.

The present invention allows for a gray pattern to be used on a document, where the gray pattern can be generated using a halftoning process to produce a desirable gray.

Since the patterns are both based on the same random screen optimization or similar random screen optimizations, the patterns look approximately identical. However, when one screen is superimposed on another screen, as for example, by see-through on a document in alignment and superposition, the correlation and non-correlation between the images becomes apparent.

While the invention has been described in conjunction with specific embodiments, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

What is claimed is:

1. A security feature for a document comprising a first pattern having a first partial image and a first background pattern, said first pattern being on a first surface of said document, and a second pattern having a second partial image and a second background pattern, said second pattern on a second surface of said document, said second surface of said document being opposite said first surface of said document, said document being sufficiently transparent wherein said first pattern and said second pattern are see-through such that said first pattern and said second pattern can be viewed at a substantially perpendicular angle, superimposed upon each other from said first surface of said document, wherein if said first pattern is aligned with said second pattern, said first partial image and said second partial image form a complete image, if said first pattern is misaligned with said second pattern, said complete image disappears, wherein lines in the first pattern and lines in the second pattern have substantially the same; and wherein the first pattern and the second pattern have tolerances of a fraction of a millimeter.

2. The security feature for a document of claim 1 wherein said first pattern and said second pattern are halftones.

3. The security feature for a document of claim 1 wherein said disappearance of said complete image is caused by phase shift and/or rotation between said first pattern and said second pattern.

4. The security feature for a document of claim 1 wherein said first partial image and said second partial image form at least one alphanumeric character.

5. The security feature for a document of claim 1 wherein said first partial image and said second partial image form at least one graphic illustration.

6. The security feature for a document of claim 1 wherein said first pattern and/or said second pattern is adjacent to printing on said first surface and/or said second surface of said document.

7. The security feature for a document of claim 1 wherein said document is transparent only at said first pattern and said second pattern.

8. The security feature for a document of claim 1 wherein said first pattern and said second pattern are on a plastic area of said document.

9. The security feature for a document of claim 8 wherein said document surrounding said first pattern and said second pattern is paper.

* * * * *